US011499109B2

(12) United States Patent
Jois et al.

(10) Patent No.: US 11,499,109 B2
(45) Date of Patent: Nov. 15, 2022

(54) FUEL COMPOSITION WITH LUBRICITY ADDITIVES

(71) Applicant: SHELL OIL COMPANY, Houston, TX (US)

(72) Inventors: Yajnanarayana Halmuthur Jois, Houston, TX (US); Joseph Michael Russo, Houston, TX (US)

(73) Assignee: SHELL USA, INC., Houston, TX (US)

( * ) Notice: Subject to any disclaimer, the term of this patent is extended or adjusted under 35 U.S.C. 154(b) by 0 days.

(21) Appl. No.: 17/423,036

(22) PCT Filed: Feb. 6, 2020

(86) PCT No.: PCT/EP2020/053047

§ 371 (c)(1),
(2) Date: Jul. 14, 2021

(87) PCT Pub. No.: WO2020/161265

PCT Pub. Date: Aug. 13, 2020

(65) Prior Publication Data

US 2022/0064558 A1 Mar. 3, 2022

Related U.S. Application Data

(60) Provisional application No. 62/802,237, filed on Feb. 7, 2019.

(51) Int. Cl.

| | |
|---|---|
| ***C10L 10/08*** | (2006.01) |
| ***C10L 1/188*** | (2006.01) |
| ***C10L 1/19*** | (2006.01) |

(52) U.S. Cl.
CPC ..... *C10L 10/08* (2013.01); *C10L 1/1881* (2013.01); *C10L 1/191* (2013.01); *C10L 2270/023* (2013.01)

(58) Field of Classification Search
CPC ..... C10L 10/08; C10L 1/1881; C10L 1/191; C10L 2270/023
See application file for complete search history.

(56) References Cited

U.S. PATENT DOCUMENTS

| | | | | |
|---|---|---|---|---|
| 6,129,772 | A * | 10/2000 | Weers | C10L 1/188 44/385 |
| 6,835,217 | B1 | 12/2004 | DeRosa et al. | |
| 6,866,690 | B2 | 3/2005 | Aradi et al. | |
| 8,287,608 | B2 | 10/2012 | Schwab | |
| 9,011,556 | B2 | 4/2015 | Schwab | |

(Continued)

FOREIGN PATENT DOCUMENTS

| | | | |
|---|---|---|---|
| CN | 104004551 | A | 8/2014 |
| CN | 106190371 | A | 12/2016 |
| CN | 108977240 | A | 12/2018 |

OTHER PUBLICATIONS

International Search Report and Written Opinion received for PCT Patent Application No. PCT/EP2020/053047, dated Apr. 2, 2020, 10 pages.

(Continued)

*Primary Examiner* — Ellen M McAvoy
(74) *Attorney, Agent, or Firm* — Shell USA, Inc.

(57) ABSTRACT

A fuel composition comprising a fuel and a lubricity additive package, where the lubricity additive package comprises (1) Dodecanoic acid and (2) 1-Lauroyl-rac-glycerol and the fuel is gasoline.

10 Claims, 3 Drawing Sheets

(56) References Cited

U.S. PATENT DOCUMENTS

| | | | | |
|---|---|---|---|---|
| 2003/0154650 | A1 | 8/2003 | Barbour et al. | |
| 2010/0031558 | A1* | 2/2010 | Goss | C10L 1/026 44/379 |
| 2010/0037513 | A1* | 2/2010 | Petrucci | C10L 1/328 44/301 |
| 2011/0146143 | A1 | 6/2011 | Alexander | |
| 2012/0167451 | A1* | 7/2012 | Festuccia | C10L 1/026 44/307 |
| 2014/0162922 | A1* | 6/2014 | Verhaeghe | C10L 1/191 508/501 |
| 2018/0094203 | A1* | 4/2018 | Gunawan | C10L 10/08 |

OTHER PUBLICATIONS

Kajdas et al., "The Influence of Fatty Acids and Fatty Acids Mixtures on the Lubricity of Low-Sulfur Diesel Fuels", SAE Technical Paper Series, vol. 1, May 7, 2001, 23 pages, XP055680007.
Office Action Received for Chinese Application No. 202080011428.X, dated Jul. 19, 2022, 11 Pages(5 Pages of English Translation and 6 Pages of Official Copy).

* cited by examiner

1: Dodecanoic Acid (50 ppm wt/v)
2: 1-Lauroyl-rac-glycerol (50 ppm wt/v)
3: Avg 1-Lauroyl-rac-glycerol / Dodecanoic Acid (25+25 ppm wt/v)
4: Dodecanoic Acid / 1-Lauroyl-rac-glycerol (10+40 ppm wt/v)
5: Avg Dodecanoic Acid / 1-Lauroyl-rac-glycerol (15+35 ppm wt/v)
6: Dodecanoic Acid / 1-Lauroyl-rac-glycerol (20+30 ppm wt/v)
7: Dodecanoic Acid / 1-Lauroyl-rac-glycerol (35+15 ppm wt/v)

FUEL COMPOSITION WITH LUBRICITY ADDITIVES

CROSS REFERENCE TO RELATED APPLICATIONS

This is a National stage application of International application No. PCT/EP2020/053047, filed 6 Feb. 2020, which claims priority of U.S. provisional application No. 62/802,237, filed 7 Feb. 2019, which is incorporated herein by reference in its entirety.

FIELD OF INVENTION

The present invention relates to fuel compositions comprising a base fuel and a lubricity additive package, and more particularly, fuel compositions comprising a base fuel and a lubricity additive package suitable for use in an internal combustion engine, a method for improving lubricity of a fuel composition, and a method for improving fuel performance of a direct injection engine.

BACKGROUND

Engine manufacturers are continuously challenged to improve engine efficiency and maximize power output, especially when designing internal combustion engines. Such engines are known to have low efficiency since a portion of the combusted fuel is not converted into useful energy but is used to overcome frictional forces. More typically, a significant portion of energy available from the combusted fuel is used to overcome frictional forces generated between surfaces of moving engine parts that are in mutual contact. The energy expended to overcome such frictional forces is considered as energy loss, or frictional loss. When higher energy requirements are necessary to overcome such losses, the amount of useful energy available to operate the engine is often reduced. To improve engine and fuel efficiency, current trends include using friction-reducing additives, friction-reducing fuel additives, or surface coatings, among others, in an effort to reduce engine frictional losses.

Friction-reducing additives, also known as friction modifiers, may be used as additives in lubricants to improve both engine and fuel efficiency. While it is understood that lubricants reduce friction between moving surfaces, the addition of friction-reducing additives to a lubricant composition may further reduce frictional losses without modifying other lubricant physical properties, such as viscosity, density, pour point, and the like. Moreover, to meet the increasing demand for more fuel-efficient vehicles, friction-reducing additives may be incorporated into fuel compositions. For example, a fuel composition comprising friction-reducing additives may be used to deliver friction modifying properties to a piston ring-cylinder wall interface of an engine where friction is high but the quantity of lubricant that flows into the area is low.

U.S. Pat. No. 6,866,690 describes a friction modifier prepared by combining saturated carboxylic acid salt and an alkylated amine and for use in a combustible fuel composition. The friction modifier can be made, for example, by mixing (i) a branched saturated carboxylic acid, or mixtures thereof, with (ii) a mono- and/or di-alkylated monoamine, and/or a mono- and/or di-alkylated polyamine, at an approximately 1:1 molar ratio. Boundary friction coefficients for the described friction modifiers were measured using a PCS Instruments High Frequency Reciprocating Rig, in which a 4 Newton (N) load was applied between a 6-millimeter (mm) diameter ANSI 52100 steel ball and an ANSI 52100 steel flat.

U.S. Pat. No. 9,011,556 describes a middle distillate fuel composition containing hydrocarbyl-substituted succinimide in a friction modifying amount. The middle distillate fuel composition was subjected to a High Frequency Reciprocating Rig (HFRR), described in ASTM method D6079, where the average HFRR wear scar diameter was recorded.

U.S. Pat. No. 6,835,217 describes a fuel composition containing a hydrocarbon fuel and a friction modifying component, which is a reaction product of at least one natural or synthetic oil and at least one alkanolamine. Lubricity tests were carried out using a High Frequency Reciprocating Rig (HFRR), described in ASTM method D6079-97, and wear scar diameter measurements were calculated based on major and minor axes.

U.S. Patent Pub. No. 2011/0146143 describes a fuel composition containing a friction reducing component for use in an internal combustion engine. The friction reducing component comprises at least one $C_6$ to $C_{30}$ aliphatic amine, including saturated fatty acid amines, unsaturated fatty acid amines, and mixtures thereof. A SRV test rig was utilized to measure the friction coefficient and wear scar performance of the components.

Many internal engine components, such as fuel pumps and injectors, are prone to excessive wear and metal damage (i.e., corrosion, erosion) due to frictional forces. Excessive friction often lends to shortened engine life, high engine replacement costs, and inefficient fuel economy since more fuel is needed to operate the engine. Yet, the aforementioned friction-reducing additives produce only marginally improvements in overcoming such challenges and other engine and fuel performance related-issues. Thus, to meet the continuing demand for enhanced friction reduction, a fuel composition is desired that provides exemplary lubricity properties and superior protection against engine frictional losses, wear, deposits, and corrosion.

DESCRIPTION OF THE DRAWINGS

Certain exemplary embodiments are described in the following detailed description and in reference to the drawings, in which.

SUMMARY OF THE INVENTION

Figure 1:
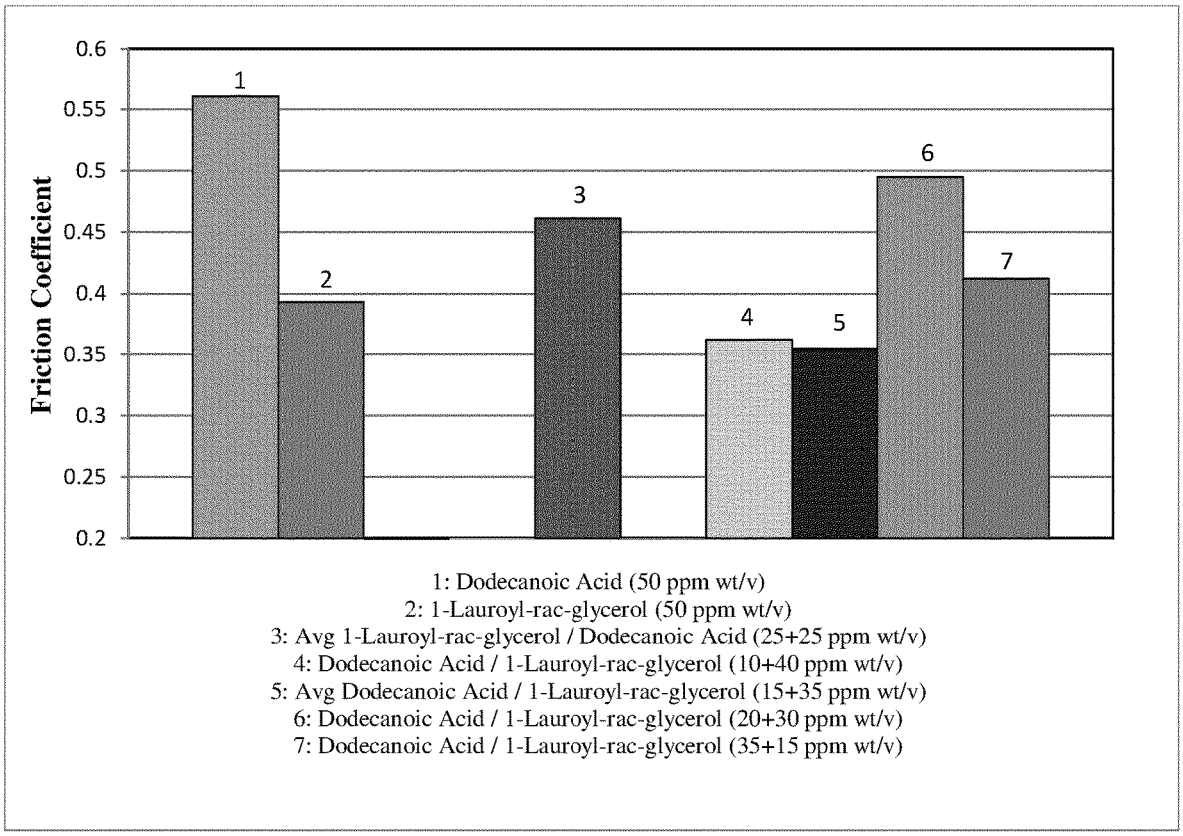
FIG. 1 presents a graphical depiction of friction coefficients for various fuel compositions.

Accordingly, the present invention relates to improved fuel compositions. More specifically, each inventive fuel composition contains a hydrocarbon base fuel and a lubricity additive package. In accordance with the present invention, the fuel composition specifically comprises gasoline as the base fuel and a lubricity additive package comprising both (1) Dodecanoic acid and (2) 1-Lauroyl-rac-glycerol.

The present invention further relates to a method for improving lubricity of a fuel composition. In particular, the method includes adding a soluble lubricity additive package to a hydrocarbon base fuel to form a fuel composition comprising improved lubricity properties. In accordance with the present invention, the method specifically comprises adding a lubricity additive package comprised of both (1) Dodecanoic acid and (2) 1-Lauroyl-rac-glycerol to gasoline, selected as the preferred base fuel.

The present invention also relates to a method of improving the fuel performance of a direct injection engine. More specifically, the present invention describes a method of fueling a direct injection engine with a fuel composition comprising a hydrocarbon base fuel and a lubricity additive package. In accordance with the present invention, the fuel composition, as used in the direct injection engine, comprises gasoline as the base fuel and a lubricity additive package comprised of (1) Dodecanoic acid and (2) 1-Lauroyl-rac-glycerol.

DETAILED DESCRIPTION

Moving machine assemblies, such as internal combustion engines, are prone to frictional losses which constitute a major portion of engine inefficiency. Frictional losses occur among engine components such as crankshaft, bearings, piston, piston rings, piston skirts, valves and valve guides, pulleys, timing belts, and connecting rods, among others. For example, reciprocating parts, such as the piston and piston rings, are the highest contributors, up to 50%, of all frictional losses among the various engine components. While it is not possible to completely eliminate friction generated during engine operations, applications such as lubricants, surface coatings, and fuels are typically used in an effort to reduce frictional losses. A lubricant generally reduces friction based on its behavior upon surface contact and/or on its ability to impose viscous shear stress on moving engine components. Current trends by some automotive manufacturers include developing surface coating to also reduce friction coefficients. Additionally, certain fuel compositions have been formulated to lower friction losses between moving components.

The present invention relates to several fuel compositions where each fuel composition comprises a lubricity additive package. Specifically, each embodiment of the fuel composition comprises a hydrocarbon base fuel and a lubricity additive package to reduce friction through surface adsorption as the composition comes into contact with moving engine parts. For instance, upon entering the combustion chamber, the lubricity additives of the inventive fuel composition adsorb onto oil films located on combustion chamber engine walls to act as an anti-friction layer between moving parts to prevent metal-to-metal contact, thus, reducing frictional losses at surface contact.

There are areas of the engine that are lubricant wetted, or that come into direct contact with the lubricant, such as the engine bearing compartment. However, there are engine components that make contact with the fuel composition, and not the lubricant (i.e., non-lubricant wetted components), that could benefit from enhanced lubricating properties. In the present embodiments, the inventive fuel composition behaves as a lubricating source for internal engine components that are both lubricant wetted and non-lubricant wetted. For example, the lubricity additive package of the inventive fuel composition may flow unchanged from the combustion chamber to the oil sump so as to accumulate over time and mix with engine lubricants, i.e., engine oils, within the oil sump. In this regard, the inventive fuel composition acts as an additional lubricant source for lubricant wetted components, such as the camshaft, crankshaft, and intake valves. Additionally, in a port fuel injection (PFI) engine, the intake valves are exposed to fuel just prior to entering the combustion chamber. Therefore, exposure to the present fuel composition not only helps to remove deposit formation but also aids in lubricating the valve stem in a valve guide. Yet, there are some areas of the engine, such as fuel injectors and fuel pumps, where the inventive fuel composition delivers the friction-reducing lubricity additive while the lubricant quantity is purposely maintained at a minimal level. Overall, the inventive fuel composition comprising the lubricity additive package substantially reduces friction among a wide range of moving engine parts, especially towards the end of an oil drain interval when lubricant chemistry is depleted and is no longer effective.

It has been surprisingly found that engines using the inventive fuel compositions exhibited significant engine improvements, including reductions in frictional losses and improved wear resistance, over engines using fuel compositions containing conventional friction-reducing additives or containing only a base fuel. For example, test data for each inventive fuel composition exhibited compelling lubricity improvements as shown by reduced friction coefficients and wear scar values as compared to that of typical fuels. Each inventive fuel composition containing the lubricity additive package also showed synergistic behavior with respect to improved engine protection including lower engine deposits and corrosive behavior. It is well-known to one skilled in the art that a reduction in friction loss often translates into higher engine output and better fuel efficiency. Therefore, another advantage as provided by the inventive fuel compositions includes increased fuel performance and improved fuel economy.

As used, herein the term "lubricity" refers to the ability, or property, of a fuel composition to reduce friction between engine component parts.

As used herein, the terms "lubricity additives" or "lubricity improvers" refer to an additive added to a base fuel composition to improve lubricity properties, thus, leading to a reduction in friction, wear, deposits, and corrosion among engine component parts.

The base fuel of the present fuel composition includes a hydrocarbon base fuel suitable for use in an internal combustion engine of the spark-ignition (petrol) type known in the art, including automotive engines and other types of engine such as off-road and aviation engines. Preferably, the base fuel comprises gasoline or a gasoline-based fuel, herein referred to as "gasoline". For example, the base fuel may include a common blend of gasoline and ethanol, such as E85 fuel which includes 15% gasoline and 85% ethanol. The amount of gasoline in the fuel can vary (typically from 15% to 90% by volume) based on geographical region and season, thereby, including an alcohol content ranging from $E_{10}$ to E85.

Gasoline can include volatile hydrocarbons boiling in the range of from about 25° C. (77° F.) to about 220° C. (428° F.) and can be derived from straight-chain naphtha, polymer gasoline, natural gasoline, catalytically cracked or thermally cracked hydrocarbons, catalytically reformed stocks, or mixtures thereof. Also, gasoline blending components which are derived from a biological source are also suitable for use.

The volatile hydrocarbons can be selected from one or more of the following groups, including, saturated hydrocarbons, olefinic hydrocarbons, aromatic hydrocarbons, oxygenated hydrocarbons, and mixtures thereof. The octane level of the gasoline will generally be above about 85. The specific hydrocarbon composition and octane level of the base fuel are not critical in the present embodiments.

Typically, the saturated hydrocarbon content of the gasoline ranges from 40% to about 80% by volume and the oxygenated hydrocarbon content ranges from 0% to about 35% by volume. When the gasoline comprises oxygenated hydrocarbons, at least a portion of non-oxygenated hydrocarbons will be substituted for oxygenated hydrocarbons. The oxygen content of the gasoline may be up to 35% by weight (EN 1601) (e.g. ethanol per se) based on the gasoline. For example, the oxygen content of the gasoline may be up to 25% by weight, preferably up to 10% by weight. Conveniently, the oxygenate concentration will have a minimum concentration selected from any one of 0, 0.2, 0.4, 0.6, 0.8, 1.0, and 1.2% by weight, and a maximum concentration selected from any one of 5, 4.5, 4.0, 3.5, 3.0, and 2.7% by weight.

Typically, the olefinic hydrocarbon content of the gasoline ranges from 0% to 40% by volume based on the gasoline (ASTM D1319). Preferably, the olefinic hydrocarbon content ranges from 0% to 30% by volume based on the gasoline, more preferably, the olefinic hydrocarbon content ranges from 0% to 20% by volume based on the gasoline. The aromatic hydrocarbon content of the gasoline ranges from 0% to 70% by volume based on the gasoline (ASTM D1319). For instance, the aromatic hydrocarbon content of the gasoline ranges from 10% to 60% by volume based on the gasoline. Preferably, the aromatic hydrocarbon content of the gasoline ranges from 10% to 50% by volume based on the gasoline, and more preferably, the aromatic hydrocarbon content ranges from 10% to 50% by volume based on the gasoline.

Gasoline may also contain mineral carrier oils, synthetic carrier oils, mixtures thereof, and/or solvents. Examples of suitable mineral carrier oils include fractions obtained in crude oil processing, such as brightstock or base oils, and fractions obtained in the refining of mineral oil such as hydrocrack oil. Examples of suitable synthetic carrier oils include polyolefins (poly-alpha-olefins or poly(internal olefin)s), (poly)esters, (poly)alkoxylates, polyethers, aliphatic polyether amines, alkylphenol-started polyethers, alkylphenol-started polyether amines and carboxylic esters of long-chain alkanols.

Examples of suitable polyolefins are olefin polymers, in particular based on polybutene or polyisobutene (hydrogenated or nonhydrogenated). Examples of suitable polyethers or polyetheramines are preferably compounds comprising polyoxy-$C_2$-$C_4$-alkylene moieties which are obtainable by reacting $C_2$-$C_{60}$-alkanols, $C_6$-$C_{30}$-alkanediols, mono- or di-$C_2$-$C_{30}$-alkylamines, $C_1$-$C_{30}$-alkylcyclohexanols or $C_1$-$C_{30}$-alkylphenols with from 1 to 30 mole of ethylene oxide and/or propylene oxide and/or butylene oxide per hydroxyl group or amino group, and, in the case of the polyether amines, by subsequent reductive amination with ammonia, monoamines or polyamines.

Examples of carboxylic esters of long-chain alkanols are in particular esters of mono-, di- or tricarboxylic acids with long-chain alkanols or polyols. The mono-, di- or tricarboxylic acids used may be aliphatic or aromatic acids; suitable ester alcohols or polyols are in particular long-chain representatives having, for example, from 6 to 24 carbon atoms. Typical representatives of the esters are adipates, phthalates, isophthalates, terephthalates and trimellitates of isooctanol, isononanol, isodecanol and isotridecanol, for example di-(n- or isotridecyl) phthalate.

Other examples of suitable synthetic carrier oils are alcohol-started polyethers having from about 5 to 35 $C_3$-$C_6$-alkylene oxide units, selected from propylene oxide, n-butylene oxide and isobutylene oxide units, or mixtures thereof, for example. Non-limiting examples of suitable starter alcohols are long-chain alkanols or phenols substituted by long-chain alkyl in which the long-chain alkyl radical is in particular a straight-chain or branched $C_6$-$C_{18}$-alkyl radical where preferred examples include tridecanol and nonylphenol.

The benzene content of the gasoline is at most 10% by volume, more preferably at most 5% by volume, and most preferably at most 1% by volume based on the gasoline. The gasoline preferably has a low or ultra-low sulfur content, for instance at most 1000 ppmw (parts per million by weight), preferably no more than 500 ppmw, more preferably no more than 100 ppmw, even more preferably no more than 50 ppmw and most preferably no more than even 10 ppmw. Moreover, the gasoline preferably has a low total lead content, such as at most 0.005 grams/liter (g/l), most preferably being lead free, thus, having no lead compounds added thereto (i.e., unleaded). The gasoline as used in the present invention may be substantially free of water since water could impede smooth combustion.

Each fuel composition of the present invention includes a lubricity additive package comprised of two different lubricity additives. In this regard, the lubricity additive package is selected as an individual component and is comprised of commercially available Dodecanoic acid and 1-Lauroyl-rac-glycerol, where each lubricity additive was selected based on its ability to effectively improve lubricity. Each lubricity additive is adequately soluble, preferably totally soluble, in a base fuel to produce the fuel composition and does not interfere or impose negative interactions with other additives that may be optionally added to the composition. The lubricity additive package is blended with a respective base fuel at a concentration of about 5 ppm (part per million) to about 100 ppm by weight, based on the total weight of the fuel composition. The ratio of Dodecanoic acid-to-1-Lauroyl-rac-glycerol in the lubricity additive package ranges from about 0.1:0.9 to 0.9:0.1, and more preferable in the range of 0.3:0.7 to 0.7:0.3.

The molecules of both Dodecanoic acid and 1-Lauroyl-rac-glycerol include a polar head group and a non-polar tail group. The polar head groups of the molecules are attracted to metal surfaces, and therefore, bind relatively strongly but reversible to such surfaces, i.e., capable of lifting and moving. With surface modifications or with impregnated ceramic fibers, the polar head group may be attracted to other surfaces, such as an alumina surface. The non-polar tail group of the molecules can be slightly longer than the molecules of the base fuel, i.e., greater than 15 atoms long, and can include a configuration that is non-linear, branched, or bent so as to enable molecule packing and fluid flow. The non-polar tail group is a hydrocarbon and thus, it can solubilize the entire molecule in the hydrocarbon base fuel. Due to the nature of the polar head group and the structure of the non-polar tail group for each lubricity additive, the inventive fuel composition surprisingly impacts engine efficiency and performance by reducing friction amongst engine components.

1-Lauroyl-rac-glycerol, as shown by (1), is formed by glycerol ester (polar head group) and lauric acid derivatives (non-polar tail group). Glycerol ester is multi-functional and typically stable when grafting to an acid. Lauric acid derivatives include molecules that are typically larger than base fuel molecules but smaller than the molecules of conventional friction modifiers.

(1)

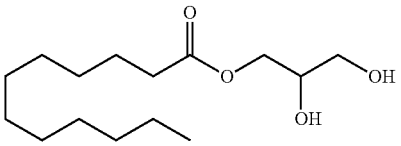

Dodecanoic acid, as shown by (2), is a saturated fatty acid with a 12-carbon atom chain, thus having properties similar to that of medium-chain fatty acids and is formed by carboxylic acid (polar head group) and lauric acid derivatives (non-polar tail group). Dodecanoic acid is the least sterically hindered of the molecules near its polar end group, thereby, allowing the carboxylic acid to more readily adsorb onto a metal surface. Also, the alky group on the Dodecanoic acid aligns itself in a more protective mode (i.e., higher cohesive forces), thereby, protecting the metal surface and allowing the carboxylic acid end group to adsorb strongly to the metal surface.

(2)

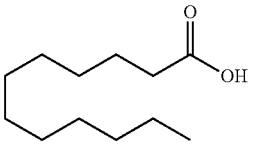

Through surface adsorption, both lubricity additives reduce the frictional properties of metal-to-metal interfaces. Specifically, the combination of flexible and multi-functional head groups along with the slightly longer tail groups enable the lubricity additive package, including 1-Lauroyl-rac-glycerol and Dodecanoic acid, to attach to multiple sites or to adsorb to a metal surface, thus, exhibiting exemplary surface adherence.

While not critical to the present invention, the fuel gasoline composition of the present invention may further include one or more optional fuel additives, in addition to the selected lubricity additives mentioned above. It should be noted that the concentration and nature of the optional fuel additive(s) in the present invention is not critical. However, the concentration of any optional fuel additive(s) present in the fuel composition can be preferably up to 1% by weight of the total fuel composition, more preferably in the range from 5 to 2000 ppmw, and most preferably in the range of from 90 to 1500 ppmw, such as from 90 to 1000 ppmw. Non-limiting examples of optional fuel additives include, but are not limited to, anti-oxidants, corrosion inhibitors, detergents, dehazers, antiknock additives, metal deactivators, valve-seat recession protectant compounds, dyes, solvents, carrier fluids, diluents and markers.

The invention will be further illustrated in more detail by the following examples. In particular, each example is based on a comparison of the friction coefficients and wear scar values for a conventional base fuel, 1-Lauroyl-rac-glycerol and a base fuel, Dodecanoic acid and a base fuel, and mixtures of 1-Lauroyl-rac-glycerol and Dodecanoic acid, at different concentrations, with a base fuel. Each fuel composition was evaluated for friction and wear scar performance using a modified high frequency reciprocating rig (HFRR) test method for gasoline (ASTM D6079-11). It should be noted that the examples are provided for illustration only and are not to be construed as limiting the present invention in any way.

Example 1

Example 1 presents friction coefficient data for Dodecanoic acid, 1-Lauroyl-rac-glycerol, and five different fuel compositions. As identified in Table 1, each of the five fuel compositions contain a lubricity additive package comprised of 1-Lauroyl-rac-glycerol and Dodecanoic acid at varying treat rates. Specifically, the formulations for each fuel composition as tested included (1) base fuel and Dodecanoic acid at a treat rate of 50 ppm wt/v (2) base fuel and 1-Lauroyl-rac-glycerol at a treat rate of 50 ppm wt/v (3) base fuel and an average value of 1-Lauroyl-rac-glycerol and Dodecanoic Acid at a treat rate of 25+25 ppm wt/v (4) base fuel and Dodecanoic Acid and 1-Lauroyl-rac-glycerol at a treat rate of 10+40 ppm wt/v in that order, i.e., 10 ppm Dodecanoic Acid+40 ppm 1-Lauroyl-rac-glycerol (5) base fuel and an average value of Dodecanoic Acid and 1-Lauroyl-rac-glycerol at a treat rate of 15+35 ppm wt/v in that order (6) base fuel and Dodecanoic Acid and 1-Lauroyl-rac-glycerol at a treat rate of 20+30 ppm wt/v in that order (7) base fuel and Dodecanoic Acid and 1-Lauroyl-rac-glycerol at a treat rate of 35+15 ppm wt/v in that order. The base fuel used in each fuel composition included E10 which is a fuel mixture of 90% gasoline and 10% ethanol usable in internal combustion engines of most automobiles and light-duty vehicles without engine or fuel system modifications. The base fuel exhibited a coefficient of friction of about 0.587 and a wear scar of about 818.9 μm when carried out using a HFRR (high frequency reciprocating rig) test method under typical conditions.

The friction coefficient for each fuel composition was determined using a HFRR test method at every second of a 900-4500 seconds test run. The HFRR tests of the present embodiments were conducted at 25° C. but can be run at various temperatures and programmed to suit the particular application of the fuel composition being tested.

TABLE 1

Friction Coefficients for Fuel Compositions

| No. | Fuel Compositions | Concentration of Lubricity Additive (ppm weight by volume) | Friction Coefficient (900-4500 sec) |
|---|---|---|---|
| 1 | Base fuel + Dodecanoic acid | 50 | 0.561 |
| 2 | Base fuel + 1-Lauroyl-rac-glycerol | 50 | 0.393 |
| 3 | Base fuel + an average value of Dodecanoic Acid + 1-Lauroyl-rac-glycerol | 25 + 25 | 0.461 |
| 4 | Base fuel + Dodecanoic Acid + 1-Lauroyl-rac-glycerol | 10 + 40 | 0.362 |
| 5 | Base fuel and an average value of Dodecanoic Acid + 1-Lauroyl-rac-glycerol | 15 + 35 | 0.355 |
| 6 | Base fuel + Dodecanoic Acid + 1-Lauroyl-rac-glycerol | 20 + 30 | 0.495 |
| 7 | Base fuel + Dodecanoic Acid + 1-Lauroyl-rac-glycerol | 35 + 15 | 0.412 |

FIG. 1 presents a graphical depiction of friction coefficients for fuel compositions at various treat rates during the 900-4500 seconds test run. As shown by FIG. 1 and in Table 1, fuel composition no. 1 (Base Fuel+Dodecanoic Acid) exhibited a coefficient of friction of about 0.561, fuel composition no. 2 (Base Fuel+1-Lauroyl-rac-glycerol) exhibited a coefficient of friction of about 0.393, fuel composition no. 3 (Base fuel and an average value of 1-Lauroyl-rac-glycerol+Dodecanoic Acid) exhibited a coefficient of friction of about 0. 461, fuel composition no. 4 (Base Fuel and Dodecanoic Acid+1-Lauroyl-rac-glycerol) exhibited a coefficient of friction of about 0.362, fuel composition no. 5 (Base fuel+an average value of Dodecanoic Acid+1-Lauroyl-rac-glycerol) exhibited a coefficient of friction of about 0.355, fuel composition no. 6 (Base fuel and Dodecanoic Acid+1-Lauroyl-rac-glycerol) exhibited a coefficient of friction of about 0.495, and fuel composition no. 7 (Base fuel and Dodecanoic Acid+1-Lauroyl-rac-glycerol) exhibited a coefficient of friction of about 0.412.

Each of the fuel compositions provided improvements in friction properties by providing a lower friction coefficient (i.e., a friction coefficient ranging from about 0.300 to about 0.600) as compared to the friction coefficient of the base fuel, which exhibited a coefficient of friction of about 0.587 when carried out using the HFRR test method under typical conditions. Moreover, the data demonstrates synergistic behavior between Dodecanoic Acid and 1-Lauroyl-rac-glycerol especially when the treat rate of 1-Lauroyl-rac-glycerol is at least double the treat rate of Dodecanoic Acid, as shown by fuel composition no. 4 and fuel composition no. 5.

Example 2

Example 2 presents comparative wear scar data for Dodecanoic acid, 1-Lauroyl-rac-glycerol, and five different fuel compositions, as identified in Table 2 where each of the five fuel compositions contain a lubricity additive package comprised of 1-Lauroyl-rac-glycerol and Dodecanoic acid at varying treat rates. Specifically, the formulations for each fuel composition as tested included (1) base fuel and Dodecanoic acid at a treat rate of 50 ppm wt/v (2) base fuel and 1-Lauroyl-rac-glycerol at a treat rate of 50 ppm wt/v (3) base fuel and an average value of 1-Lauroyl-rac-glycerol and Dodecanoic Acid at a treat rate of 25+25 ppm wt/v (4) base fuel and Dodecanoic Acid and 1-Lauroyl-rac-glycerol at a treat rate of 10+40 ppm wt/v in that order, i.e., 10 ppm Dodecanoic Acid+40 ppm 1-Lauroyl-rac-glycerol] (5) base fuel and an average value of Dodecanoic Acid and 1-Lauroyl-rac-glycerol at a treat rate of 15+35 ppm wt/v in that order (6) base fuel and Dodecanoic Acid and 1-Lauroyl-rac-glycerol at a treat rate of 20+30 ppm wt/v in that order (7) base fuel and Dodecanoic Acid and 1-Lauroyl-rac-glycerol at a treat rate of 35+15 ppm wt/v in that order. The base fuel used in each fuel composition included E10 which is a fuel mixture of 90% gasoline and 10% ethanol usable in internal combustion engines of most automobiles and light-duty vehicles without engine or fuel system modifications.

Wear scar values for each fuel composition were determined using a HFRR test method provided in micrometers (μm). The HFRR tests of the present embodiments were conducted at 25° C. but can be run at various temperatures and programmed to suit the particular application of the fuel composition being tested.

TABLE 2

Wear Scar Data for Fuel Compositions

| No. | Fuel Compositions | Concentration of Lubricity Additive (ppm weight by volume) | Wear Scar (micrometer (μm)) |
|---|---|---|---|
| 1 | Base fuel + Dodecanoic acid | 50 | 513.5 |
| 2 | Base fuel + 1-Lauroyl-rac-glycerol | 50 | 758.0 |
| 3 | Base fuel + an average value of 1-Lauroyl-rac-glycerol + Dodecanoic Acid | 25 + 25 | 528.2 |
| 4 | Base fuel + Dodecanoic Acid + 1-Lauroyl-rac-glycerol | 10 + 40 | 677.5 |
| 5 | Base fuel and an average value of Dodecanoic Acid + 1-Lauroyl-rac-glycerol | 15 + 35 | 650.8 |
| 6 | Base fuel + Dodecanoic Acid + 1-Lauroyl-rac-glycerol | 20 + 30 | 559.0 |
| 7 | Base fuel + Dodecanoic Acid + 1-Lauroyl-rac-glycerol | 35 + 15 | 528.0 |

Figure 2:
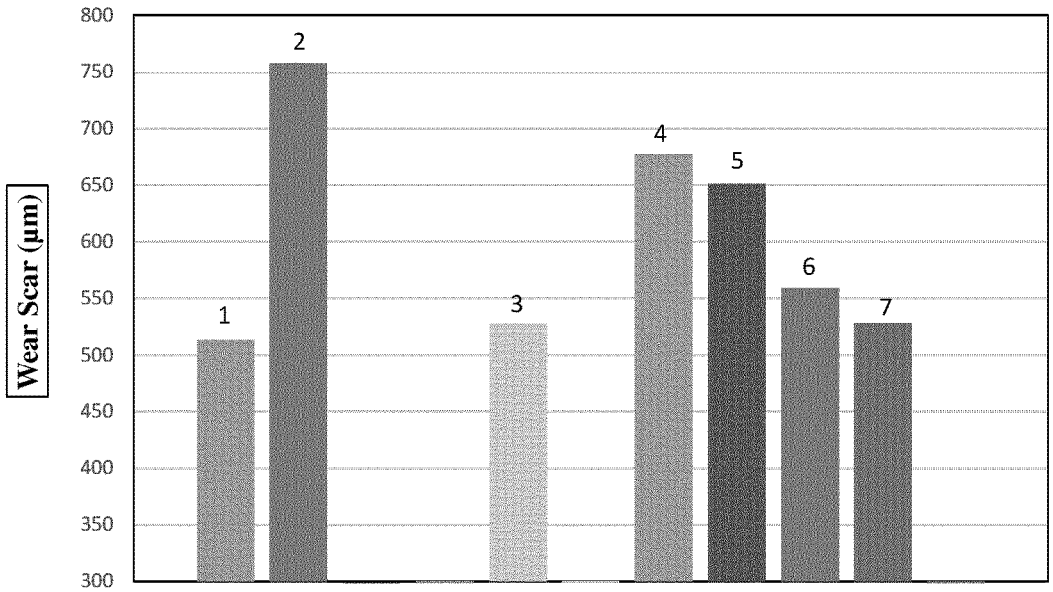
FIG. 2 presents a graphical depiction of wear scar values for various fuel compositions.

FIG. 2 presents a graphical depiction of wear scar values for fuel compositions at various treat rates. Fuel composition no. 1 (Base Fuel+1 Dodecanoic Acid) exhibited a wear scar value of about 513.5 μm, fuel composition no. 2 (Base Fuel+1-Lauroyl-rac-glycerol) exhibited a wear scar value of about 758 μm, fuel composition no. 3 (Base fuel and an average value of 1-Lauroyl-rac-glycerol+Dodecanoic Acid) exhibited a wear scar value of about 528.2 μm, fuel composition no. 4 (Base Fuel and Dodecanoic Acid+1-Lauroyl-rac-glycerol) exhibited a wear scar value of about 677.5 μm, fuel composition no. 5 (Base fuel+an average value of Dodecanoic Acid+1-Lauroyl-rac-glycerol) exhibited a wear scar value of about 650.8 μm, fuel composition no. 6 (Base fuel and Dodecanoic Acid+1-Lauroyl-rac-glycerol) exhibited a wear scar value of about 559 μm, and fuel composition no. 7 (Base fuel and Dodecanoic Acid+1-Lauroyl-rac-glycerol) exhibited a wear scar value of about 528 μm. As provided in Table 2 and as shown in FIG. 2, each of the fuel compositions provided improvements in wear scar (i.e., a wear scar ranging from about 480 μm to about 680 μm) as compared to the wear scar of the base fuel without additives, which exhibited a wear scar value of about 818.9 μm when carried out using the HFRR test under typical conditions.

Example 3

Figure 3:
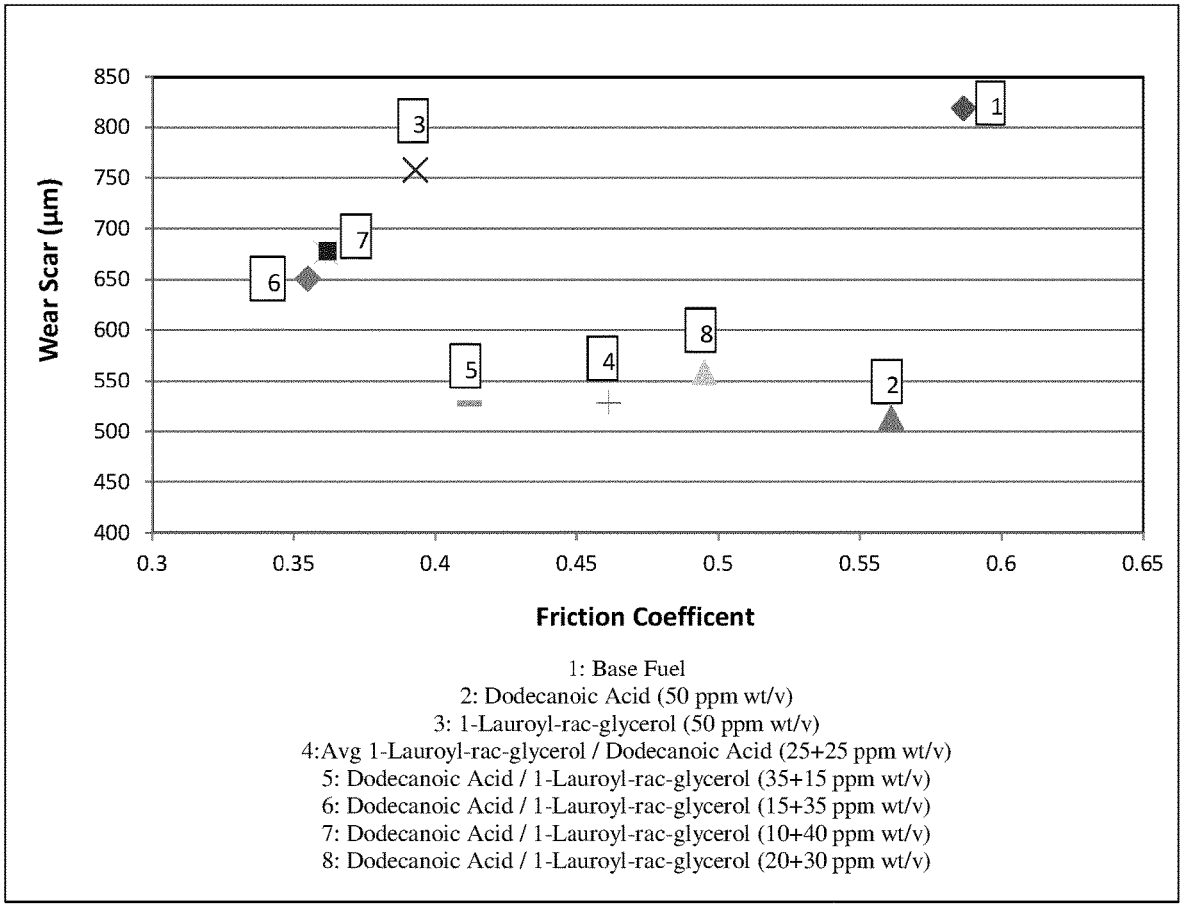
FIG. 3 presents a graphical comparison of wear scar and friction coefficient data for each fuel composition.

FIG. 3 presents a graphical comparison of wear scar and friction coefficient data for each of the fuel compositions. Specifically, the formulations for each fuel composition as tested included (1) base fuel only; (2) base fuel and Dodecanoic acid at a treat rate of 50 ppm wt/v; (3) base fuel and 1-Lauroyl-rac-glycerol at a treat rate of 50 ppm wt/v; (4) base fuel and an average value of 1-Lauroyl-rac-glycerol and Dodecanoic Acid at a treat rate of 25+25 ppm wt/v; (5) base fuel and Dodecanoic Acid and 1-Lauroyl-rac-glycerol at a treat rate of 35+15 ppm wt/v, in that order; (6) base fuel and an average value of Dodecanoic Acid and 1-Lauroyl-rac-glycerol at a treat rate of 15+35 ppm wt/v, in that order; (7) base fuel and Dodecanoic Acid and 1-Lauroyl-rac-glycerol at a treat rate of 10+40 ppm wt/v, in that order; (8) base fuel and Dodecanoic Acid and 1-Lauroyl-rac-glycerol at a treat rate of 20+30 ppm wt/v, in that order. The wear scar and the friction coefficient values for each inventive fuel composition was plotted against the wear scar and the friction coefficient for the base fuel only composition. When combining such data on one plot, those skilled in the art can readily ascertain that a fuel composition comprising a base fuel and the lubricity additive package provides improved wear scar and friction reduction when compared to a base only fuel composition. In particular, FIG. 3 shows synergistic behavior between the dodecanoic acid and the 1-Lauroyl-rac-glycerol lubricity additives since the coefficient of friction for the compositions are less than the friction coefficient for either Dodecanoic acid or the base fuel, as individual components. Concerning wear scar, all fuel compositions exhibit lower wear scar values than the base fuel.

The objective of the present invention included evaluating whether a lubricity additive package added to a base fuel would increase the lubricating properties of the base fuel when added therein. The lubricity additive package was comprised of Dodecanoic acid and 1-Lauroyl-rac-glycerol where each was selected based on its varying polar and non-polar groups and unique chemistries. Each lubricity additive (i.e., Dodecanoic acid and 1-Lauroyl-rac-glycerol) was individually added to the base fuel at varying concentrations to form several fuel compositions. Each fuel composition was later tested to determine its level of lubricity. The results of Examples 1-3 indicate that the objectives were met where each fuel composition comprising the lubricity additive package demonstrated improved lubricating properties as shown by reduced friction coefficient and wear scar data.

Synergistic results from combining a lubricity additive package together with the base fuel generated more benefits than adding an individual lubricity additive to a base fuel or use of the base fuel alone. In particular, the fuel composition comprising the lubricity additive package improved engine efficiency and performance as shown by reduced friction coefficient and wear scar data. Such lubricity improvements to a fuel composition can provide protection to various direct injection engines components, such as high-pressure fuel pumps and injectors. In another surprising benefit, each fuel composition including the lubricity additive package can also be used to improve fuel performance of a direct injection engine or any time of engine suitable for gasoline use.

While the present techniques may be susceptible to various modifications and alternative forms, the exemplary examples discussed above have been shown only by way of example. It is to be understood that the technique is not intended to be limited to the particular examples disclosed herein. Indeed, the present embodiments include all alternatives, modifications, and equivalents falling within the scope of the present techniques.

We claim:

1. A fuel composition comprising:

a base fuel comprising gasoline or a gasoline-based fuel;

a lubricity additive package; and wherein the lubricity additive package comprises (1) Dodecanoic acid and (2) 1-Lauroylrac-glycerol, wherein the lubricity additive package is blended with the base fuel at a concentration of 5 ppm to 100 ppm by weight, based on the total weight of the fuel composition, and wherein the treat rate of 1-Lauroyl-rac-glycerol is at least double the treat rate of Dodecanoic acid.

2. The fuel composition according to claim 1, wherein the fuel composition provides a coefficient of friction ranging from 0.300 to 0.600 as measured according to ASTM D6079-11.

3. The fuel composition according to claim 1, wherein the fuel composition provides a wear scar diameter ranging from 480 μm to 680 μm as measured according to ASTM D6079-11.

4. The fuel composition according to claim 1, wherein the lubricity additive package is soluble in the fuel.

5. The fuel composition according to claim 1, wherein the fuel composition has a sulfur concentration of less than about 50 ppm.

6. A method for improving lubricity of a fuel composition, the method comprising, providing a base fuel comprising gasoline or a gasoline-based fuel;

adding a lubricity additive package to the base fuel;

wherein the lubricity additive package comprises (1) Dodecanoic acid and (2) 1-Lauroyl-rac-glycerol, wherein the lubricating additive package is blended with the base fuel at a concentration of 5 ppm to 100 ppm by weight, based on the total weight of the fuel composition, and wherein the treat rate of 1-Lauroyl-rac-glycerol is at least double the treat rate of Dodecanoic acid.

7. The method according to claim 6, wherein the fuel composition provides a coefficient of friction ranging from 0.300 to 0.600 as measured according to ASTM D6079-11 after adding the lubricity additive package to the base fuel.

8. The method according to claim 6, wherein the fuel composition provides a wear scar diameter ranging from 480 μm to 680 μm as measured according to ASTM D6079-11 after adding the lubricity additive package to the base fuel.

9. A method for improving fuel performance of a direct injection engine, wherein the method comprises, fueling the direct injection engine with a fuel composition comprising a base fuel comprising gasoline or a gasoline-based fuel and a lubricity additive package; and operating the direct injection engine;

wherein the lubricity additive package comprises (1) Dodecanoic acid and (2) 1-Lauroyl-rac-glycerol wherein the lubricating additive package is blended with the base fuel at a concentration of 5 ppm to 100 ppm by weight, based on the total weight of the fuel composition, and wherein the treat rate of 1-Lauroyl-rac-glycerol is at least double the treat rate of Dodecanoic acid.

10. The method according to claim 9, wherein the fuel performance exhibited by the direct injection engine after fueling with the fuel composition is measured by the fuel composition providing a coefficient of friction ranging from 0.300 to 0.600 as measured according to ASTM D6079-11 and a wear scar diameter ranging from 480 μm to 680 μm as measured according to ASTM D6079-11.

* * * * *